US007210172B2

(12) United States Patent
Adams, Jr.

(10) Patent No.: US 7,210,172 B2
(45) Date of Patent: May 1, 2007

(54) FINGERTIP FLEXOR GLOVE

(76) Inventor: Merle Harrison Adams, Jr., 306 Meagher Ave., Bozeman, MT (US) 59718

( * ) Notice: Subject to any disclaimer, the term of this patent is extended or adjusted under 35 U.S.C. 154(b) by 0 days.

(21) Appl. No.: 11/160,968

(22) Filed: Jul. 18, 2005

(65) Prior Publication Data

US 2007/0028357 A1 Feb. 8, 2007

(51) Int. Cl.
*A41D 19/00* (2006.01)

(52) U.S. Cl. ..... 2/163; 2/160; 2/161.5; 2/161.1; 2/21; 482/47; 482/48; 482/49; 482/4

(58) Field of Classification Search ..... 2/163, 2/160, 161.1, 161.5, 21; 602/5; 482/47, 482/48, 49, 4

See application file for complete search history.

(56) References Cited

U.S. PATENT DOCUMENTS 474,929 A * 5/1892 Tabor et al. ..... 2/163
3,224,012 A * 12/1965 Hamm ..... 2/161.1
3,707,730 A * 1/1973 Slider ..... 2/161.1
RE32,287 E * 11/1986 Willis ..... 2/16
4,706,658 A 11/1987 Cronin
4,738,447 A * 4/1988 Brown ..... 473/450
4,781,178 A * 11/1988 Gordon ..... 602/22
4,843,651 A * 7/1989 Gramza et al. ..... 2/161.1
4,958,384 A * 9/1990 McCrane ..... 2/161.6
5,476,439 A * 12/1995 Robinson ..... 601/40
5,498,234 A 3/1996 Martel et al.
5,604,933 A * 2/1997 Stephens ..... 2/159
5,636,381 A * 6/1997 Brogden ..... 2/161.1
5,706,521 A * 1/1998 Haney ..... 2/160
5,746,707 A 5/1998 Eck
5,768,711 A * 6/1998 Wissink ..... 2/161.1
5,794,265 A 8/1998 Reich
5,829,057 A 11/1998 Gunn
6,010,473 A * 1/2000 Robinson ..... 602/21
6,049,910 A * 4/2000 McCarter ..... 2/161.1
6,223,353 B1 * 5/2001 Lardieri, Jr. ..... 2/161.1
6,475,174 B1 * 11/2002 Chow ..... 602/5
6,496,984 B1 12/2002 Chow
6,539,550 B1 * 4/2003 Flores ..... 2/16
6,571,397 B1 6/2003 Williams
6,745,402 B2 * 6/2004 Caswell ..... 2/161.1

* cited by examiner

*Primary Examiner*—Gary L. Welch
*Assistant Examiner*—Alissa Tompkins
(74) *Attorney, Agent, or Firm*—Head, Johnson & Kachigian

(57) ABSTRACT

A rigid glove has openings at the ends of the fingers such that the ends of the fingers from the most distal joint to the end protrude therefrom. The fingers may be flexed as an exercise. Caps of varying resistance may also be applied to the ends of the glove's fingers.

10 Claims, 10 Drawing Sheets

FINGERTIP FLEXOR GLOVE

BACKGROUND OF THE INVENTION

1. Field of the Invention

The present invention relates to an exercise device for strengthening the most distal phalanges, the digits. Specifically, the exercise device allows the wearer to isolate and strengthen the muscles that control the digits.

2. Prior Art

Sports at all levels are highly competitive. Athletes are constantly practicing and exercising to improve their ability in a particular sport. Countless exercise devices have been designed to isolate and improve the strength of both muscle groups and individual muscles. While most attention has focused on the larger muscle groups of the legs, arms and trunk, little attention has been given to exercising various muscles that give strength to the fingers. This is somewhat surprising considering that most sports require the handling of a ball or other instrument in which a strong grip is important. The most important part of an athlete's grip lies in the digits, the most distal phalanges of the fingers. The ends of the fingers are vital for gripping a basketball or football, as well as many other sport objects. While many glove devices have been designed, none allow the wearer to focus on strengthening his or her digits.

Cronin (U.S. Pat. No. 4,706,658) discloses a splint across the palm and includes extensions for supporting the fingers and perhaps the thumb. Although it discloses a somewhat rigid glove optionally having flexible joints, it does not disclose a rigid glove that only allows flexing of the most distal joints.

Martel et al. (U.S. Pat. No. 5,498,234) discloses a hand and arm support. The front edge includes spaced finger holes, while the rear edge defines an opening for a hand. The glove body is made from a thin lightweight elastic spandex material. This patent only discloses use of an elastic material.

Stephens (U.S. Pat. No. 5,604,933) discloses a hand and wrist restraint for a patient. This glove is made of soft material, such as cotton, and therefore does not disclose the present invention. Eck (U.S. Pat. No. 5,746,707) discloses a wrist and two digit restraining device for the treatment of carpal tunnel syndrome. The device comprises a palmar brace having a wrist support receiving the wrist of a patient, a portion supporting the heel and palm of the patient's hand and terminating at the base of the second, third and forth fingers of the hand. This device does not allow for flexing of the digits.

Reich (U.S. Pat. No. 5,794,265) discloses a garment sleeve adapted to receive the arm and hand of a user and so constructed that the palm of the user is protected, with finger movement unrestricted, as the hand extends out of the distal end of the sleeve and at the same time the distal end is sealed against entry of wind, air, rain and the like. This patent allows free movement of the fingers.

Gunn (U.S. Pat. No. 5,829,057) discloses an article which incorporates fabrics or chemicals having a low coefficient of friction either overall or in specific areas of the apparel. This device does not disclose a rigid glove.

Robinson (U.S. Pat. No. 6,010,473) discloses a remedial hand wear article comprising a glove for comfortably fitting onto a hand of an individual, an enclosure superimposed on a top side of the glove and permanently attached thereto, and a substantially rigid member positioned within the enclosure and operably associated with a finger of the individual to position that finger in a desired posture. The glove portion of the hand wear article provides comfort to the user while also serving to lessen the noticeability of any hand or finger grotesqueness. A proximal knuckle of at least one finger is blocked to prevent hyperextension, while the proximal knuckle and the distal knuckles of the finger are capable of full anatomical finger flexure.

Chow (U.S. Pat. No. 6,475,174) discloses a sleeve having a splint to partially immobilize the thumb side of a hand. It does not disclose a rigid glove and allows only movement about the most distal knuckle.

Chow (U.S. Pat. No. 6,496,984) discloses a sleeve, including a splint very similar to the previous patents. The only substantial difference is in the location of the rigid splint. Like the previous patent, it does not disclose the rigid glove similar to the present invention.

Flores (U.S. Pat. No. 6,539,550) discloses a set of three driving gloves, each having a different length to be worn by a driver. Each glove has a varying length with finger portions cut away to allow for greater flexibility when driving. This patent discloses cut-away finger portions of the glove so that the fingers may be flexed.

Williams (U.S. Pat. No. 6,571,397) discloses protective garments, such as gloves and socks and the method of making the same that are comfortable to wear and at the same time provide a high degree of protection to the user against exposure to various chemical vapors, and hazardous agents including noxious gases. This invention does not disclose the use of rigid gloves.

None of these patents disclose a device suitable for flexing the digits only and keeping all of the joints in the hand stationary. They are therefore not suitable for exercising and strengthening the ends of the fingers.

It is therefore desirable to provide a device for exercising the most distal phalanges, or digits.

It is also desirable to provide a device for isolating and flexing only the digits while maintaining the rest of the hand in a stationary position.

SUMMARY OF THE INVENTION

The present invention provides a rigid glove having openings at the ends of the fingers. When inserted onto a hand, only the most distal phalanges, the digits, protrude from the holes at the ends of the fingers of the glove. It may be flexed while the rest of the hand is firmly held in a stationary position by the rigid glove. This allows a person to exercise his or her digits, thereby strengthening them. This improves an athlete's ability to grasp an item, such as a ball, a bat or an opponent. Those skilled in the art will appreciate that the improved strength of an athlete's digits will substantially improve an athlete's performance.

Optionally, the gloves may be designed such that caps may be placed on the ends of the glove's fingers. These caps may be formed of rubber or another elastic material so as to provide resistance to the flexing of the digits. The gloves are preferably designed such that they may accommodate different caps that provide varying degrees of resistance to flexing of the digits. This allows an athlete to progressively increase the strength of his or her digits.

The object of the present invention is to provide a device for training athletes to rely more heavily on the strength and flexion of their digits rather than the other metacarpals of the hand.

The present invention also includes other alternative means of applying resistance to the flexing of the digits.

DETAILED DESCRIPTION OF THE PREFERRED EMBODIMENTS

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The present invention comprises a rigid glove. It may be made of any material so long as it is sufficiently rigid to prevent all but the last knuckle and digits of the fingers from moving. Preferably, the glove is made of plastic because it is relatively cheap. However, those skilled in the art will appreciate that it may be made of metal, wood, carbon fiber or any other suitable material. The glove is preferably not made of glass in order to avoid injury. Optionally, the glove may be lined with rubber or other soft cushiony material. The glove may also be perforated with one or more holes in the glove to minimize perspiration.

The rigid glove is designed to increase the flexibility and strength of the distal interphalangeal joints (DIP) of the index to the little finger. The fulcrum of the glove is just proximal to the DIP joint of the index through the little finger and the glove is rigid such that it prevents flexion of the proximal interphalangeal joint and metacarpal phalangeal joints. Thus, it focuses specifically on the flexion of the DIP joint. The primary muscle group that causes flexion of the DIP is the flexor digitorum profundus muscle which is in the volar or anterior aspect of the forearm.

By restricting an athlete's use of his or her hand to flexion of the DIP joint, the invention strengthens the flexor digitorum profundus muscle and teaches the athlete to rely more heavily on the strength and flexion of the DIP joint. This results in the athlete's improved ability to catch, handle, hold and otherwise manipulate a ball or other instrument.

Figure 1:
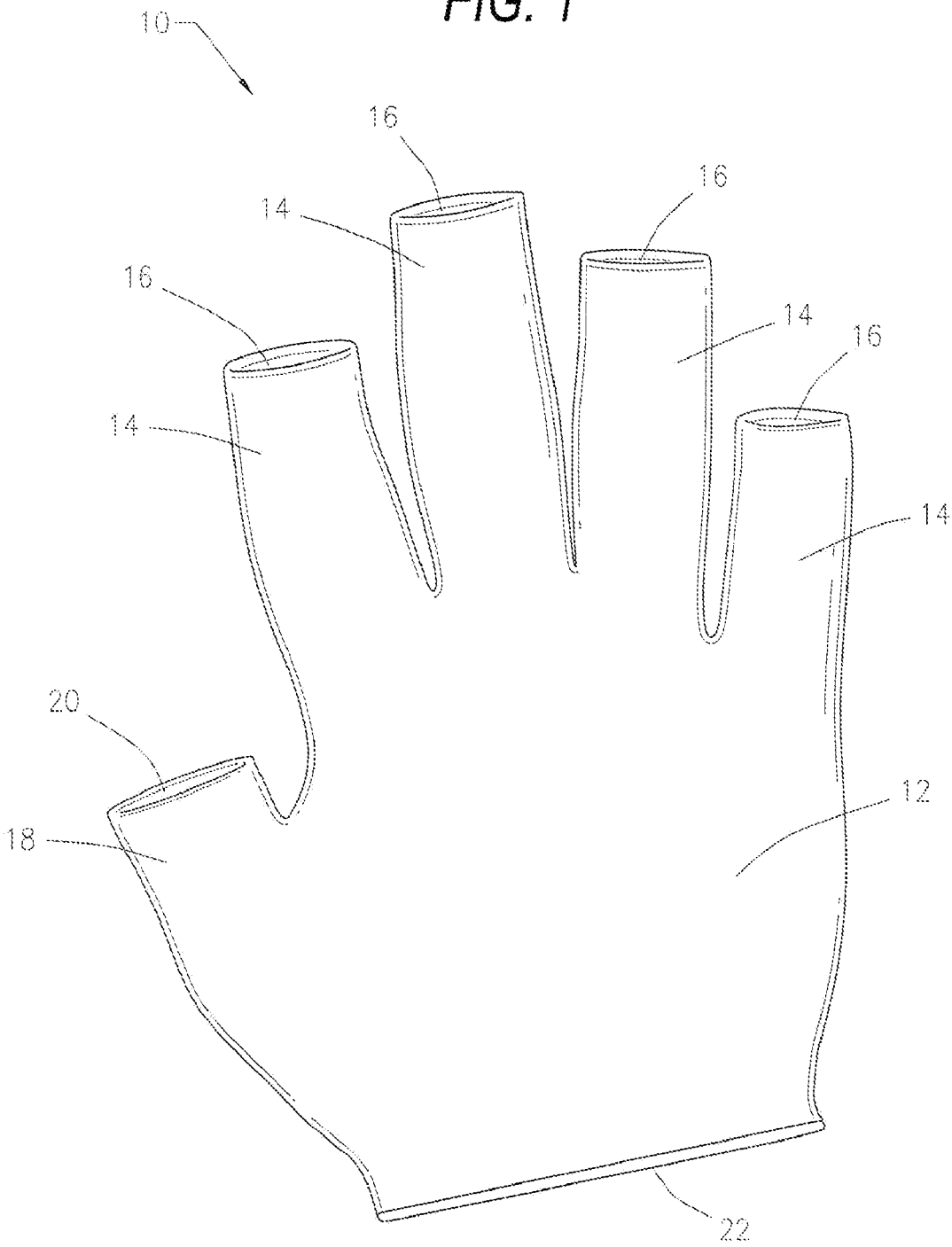
FIG. 1 shows a top plan view of the invention.

FIG. 1 is a top plan view of an embodiment of the present invention. Exercise device 10 is a glove having a body 12 that covers substantially all of the palm and back of the hand. Device 10 also has fingers 14 and thumb region 18. Fingers 14 and thumb region 18 are substantially cylindrical. The entire glove is designed to fit snugly about a person's hand. The hand enters through opening 22 in body 12. The ends of the fingers protrude from opening 16, while the end of the thumb protrudes from opening 20.

Figure 2:
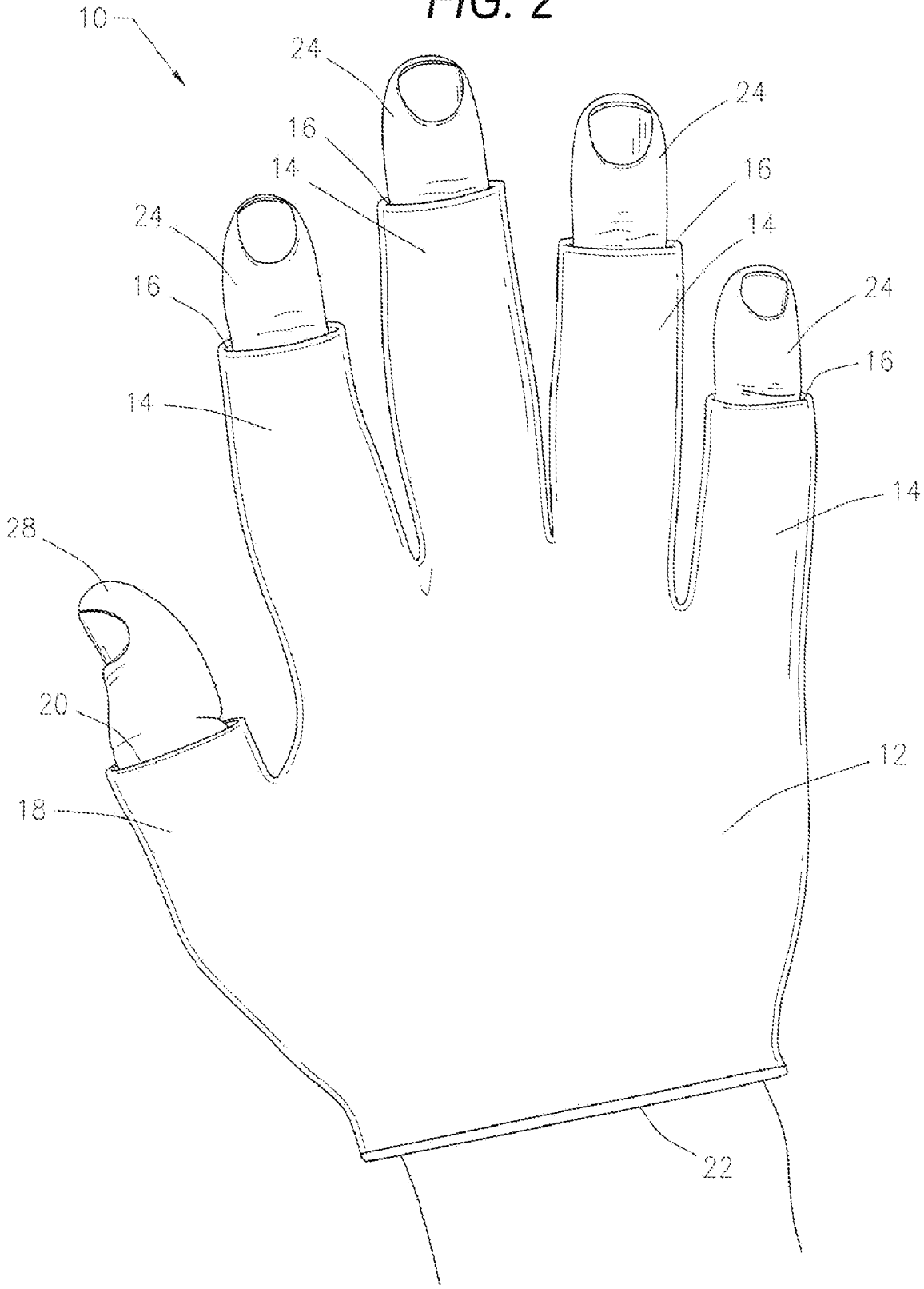
FIG. 2 shows a top plan view of the invention as used with a hand.
Figure 3:
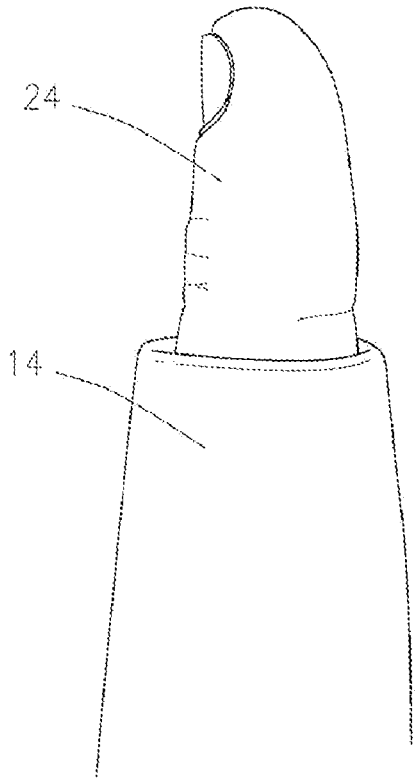
FIG. 3 shows a side view of the invention.
Figure 4:
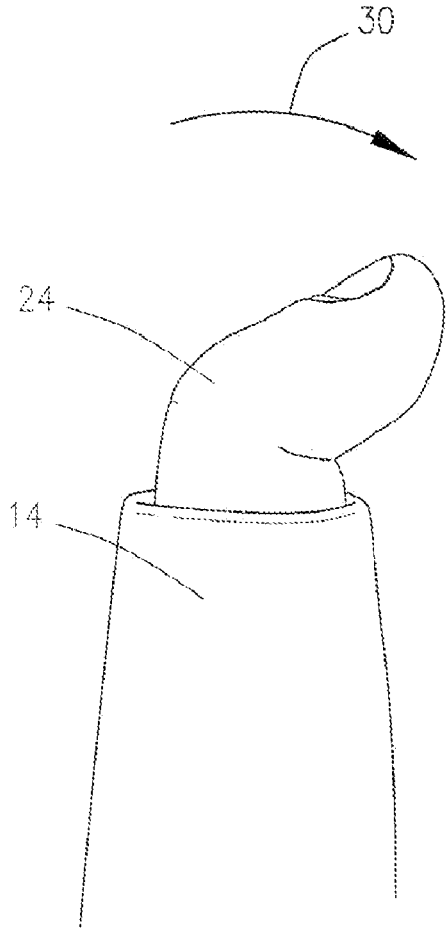
FIG. 4 shows a side view of the invention and operator's finger being flexed.

When the glove is worn as shown in FIG. 2, the most distal joints may be flexed, causing the digits of the fingers to bend palm-ward. This movement is repeated in order to exercise the ends of the fingers and strengthen the finger muscles. This can be more clearly seen in FIGS. 3 and 4. FIGS. 3 and 4 show a side view of a finger member 14 of the device. The end of finger 24 protrudes outward from hole 16. When the digit is flexed, it moves in the direction of arrow 30 as shown in FIG. 4. The finger is then relaxed such that it returns to the position shown in FIG. 3. This is repeated many times over to increase muscle tone and strength of the muscles that control the position of the digits.

Figure 5:
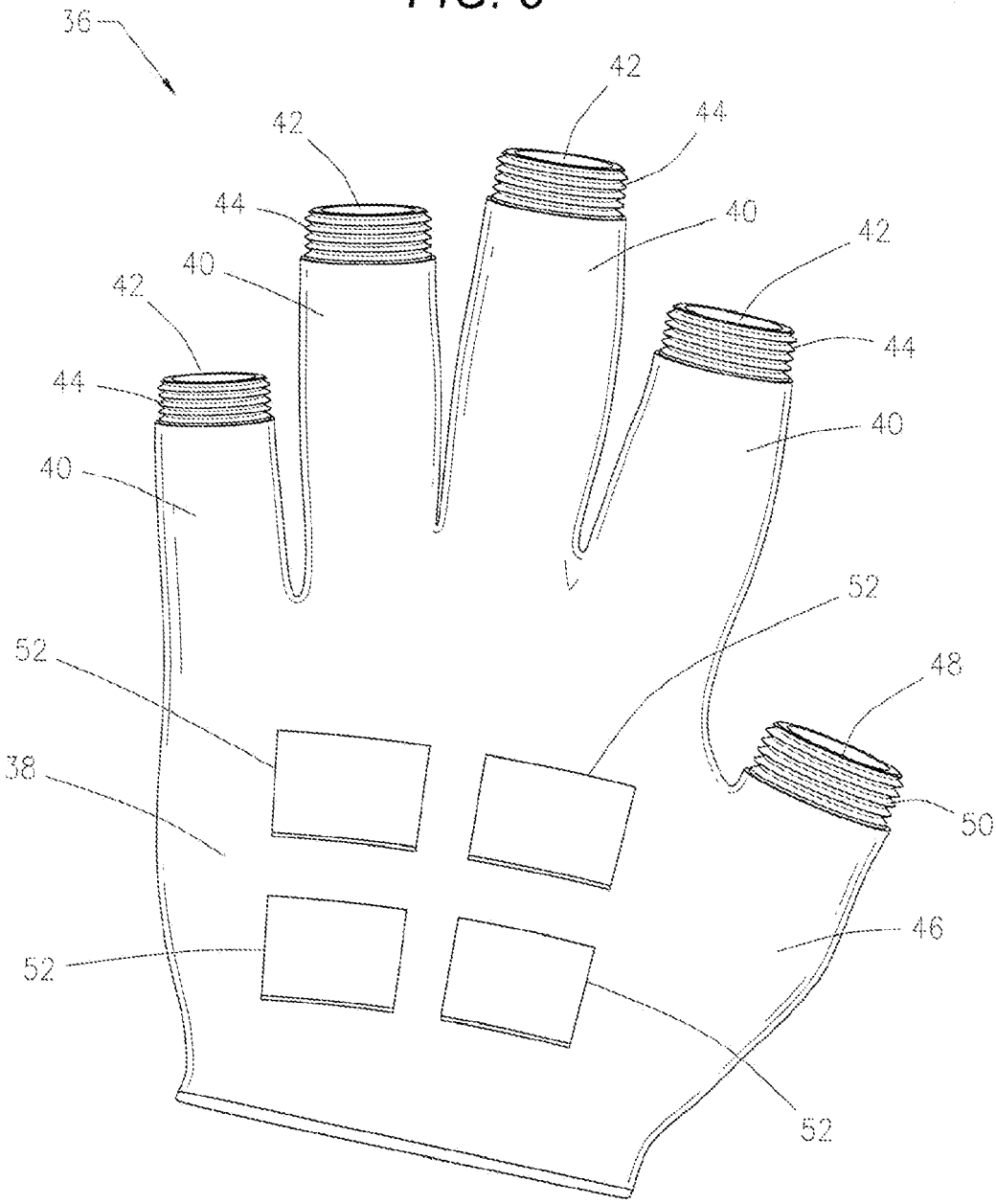
FIG. 5 shows an alternative embodiment of the invention.

FIG. 5 shows an alternative embodiment of the present invention. As with the embodiment shown in FIGS. 1–4, this embodiment shows a palm region 38, cylindrical finger regions 40 and a thumb region 46. Finger regions 40 each have holes at their ends 42. Thumb region 46 has a hole 48 from which the thumb may protrude. This embodiment also includes openings 52. These openings provide an advantage in that it both reduces the amount of material needed to make the device, thereby saving money, and it allows air to come into contact with the hand being exercised. This reduces perspiration and increases comfort to the wearer.

Figure 6:
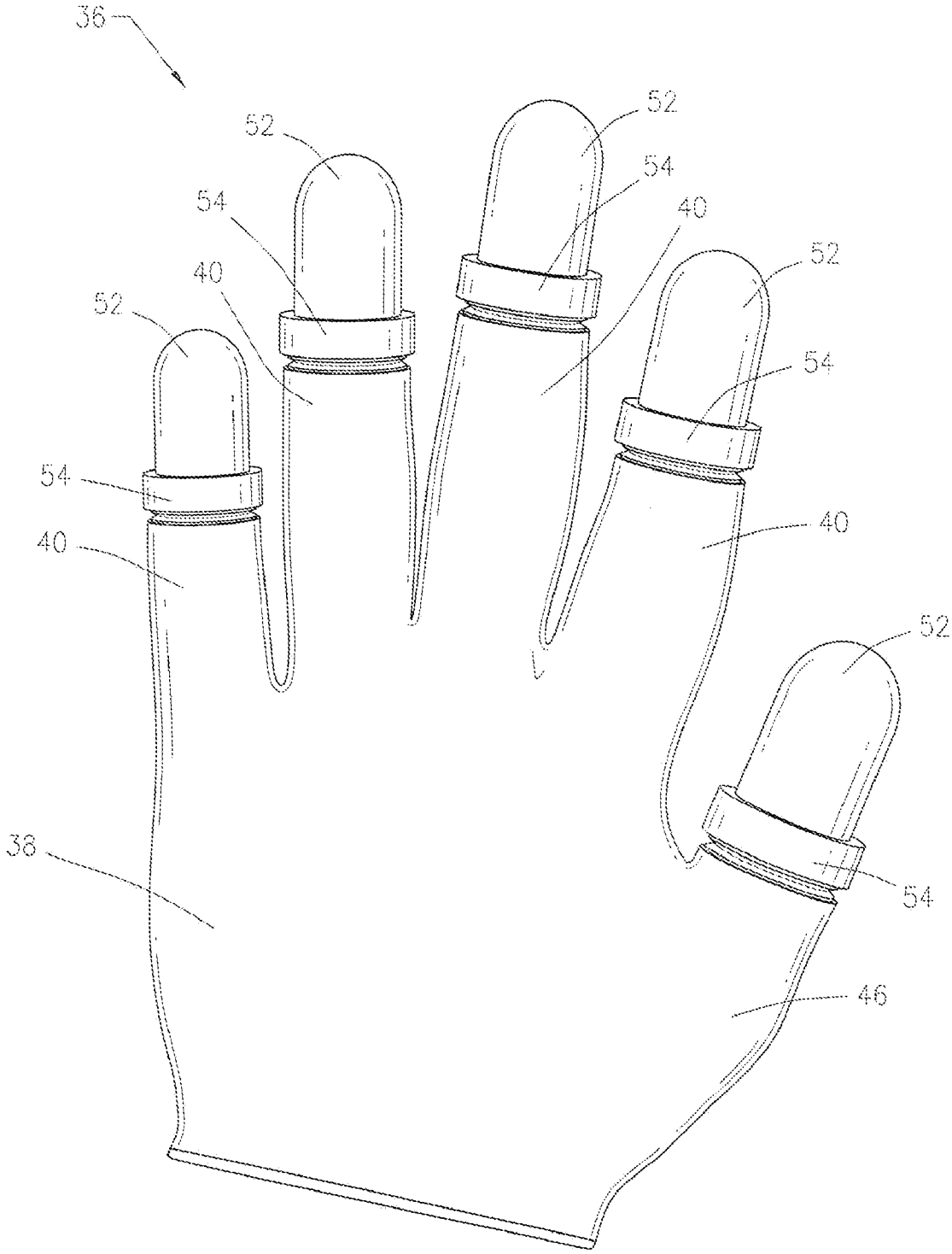
FIG. 6 shows an alternative embodiment to the invention.

The embodiment shown in FIGS. 5 and 6 also show threading 44 on finger regions 40 and threading on thumb region 46. This threading allows caps to be screwed onto the ends of these finger and thumb regions. The caps can be comprised of rubber or another elastomer to provide resistance to the finger motion illustrated in FIGS. 3 and 4.

FIG. 6 shows exercise device 36 with the resistance caps 52 in place. Each resistance cap includes an attachment region 54. In this particular embodiment, attachment portion 54 is comprised of a rigid material that is the same as or similar to the material used to make the device 36. This is necessary when threading is used to screw the resistance caps 52 onto the exercise device 36. Because resistance caps 52 are comprised of an elastic material, resistance is provided against movement of the digits. Those skilled in the art will appreciate that sets of caps may be produced having essentially the same amount of resistance to movement. One set is preferably the same color. Alternatively, the common set may all be identified by markings on the outside of the caps. Different sets of caps may be produced to provide different amounts of resistance. For example, a set of yellow caps could be made offering relatively little resistance, a set of blue caps could offer medium resistance, and a set of red caps could offer high resistance. This allows an operator to substantially build up the muscles that control the digits of the fingers. While this embodiment shows the caps being attached by means of threading, those skilled in the art will appreciate that a variety of methods may be used to attach the resistance caps, including, but not limited to, a tongue and groove mechanism, snaps, tabs, and other methods known in the art.

Figure 7:
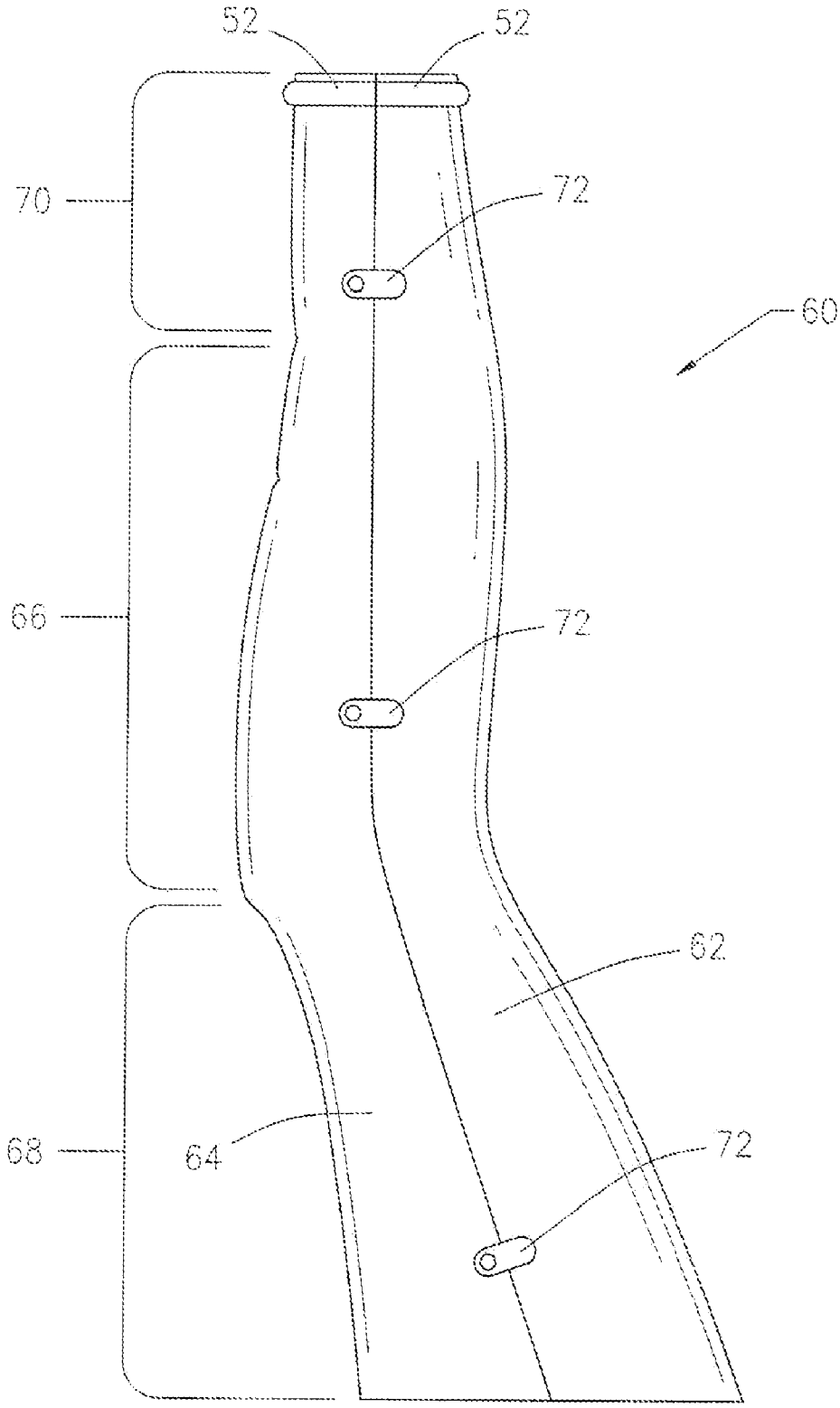
FIG. 7 shows a side view of an alternative embodiment of the invention.

FIG. 7 shows a side view of an alternative embodiment of the present invention. This embodiment comprises a top half 62 and a bottom half 64 that are removably attached by means of latches 72. Those skilled in the art will appreciate that a rigid glove may be difficult to slide a hand into. It may, therefore, be desirable to provide a glove that disassembles into two or more pieces. In this embodiment, the glove disassembles into two pieces, but those skilled in the art will appreciate the glove may disassemble into three, four or even more pieces. The glove may include latches 72 on both sides or may have latches 72 on only one side with hinges on the opposite side. Those skilled in the art will appreciate that this is a relatively minor difference.

The device shown in FIG. 7 also extends further than the previous embodiments. The device 16 has a finger region 70, a palm region 66 and a wrist/forearm region 68. Region 68 holds the wrist joint stationary while exercising. Those skilled in the art will appreciate that such a design will serve to further isolate the muscles that control the digits. FIG. 7 also includes flange 74. Flange 74 is used to attach the resistance caps to the device. The elastic caps are stretched over flange 74. Resistance holds them in place. As stated above, those skilled in the art will appreciate that this is only one of many methods to attach resistance caps.

Figure 8:
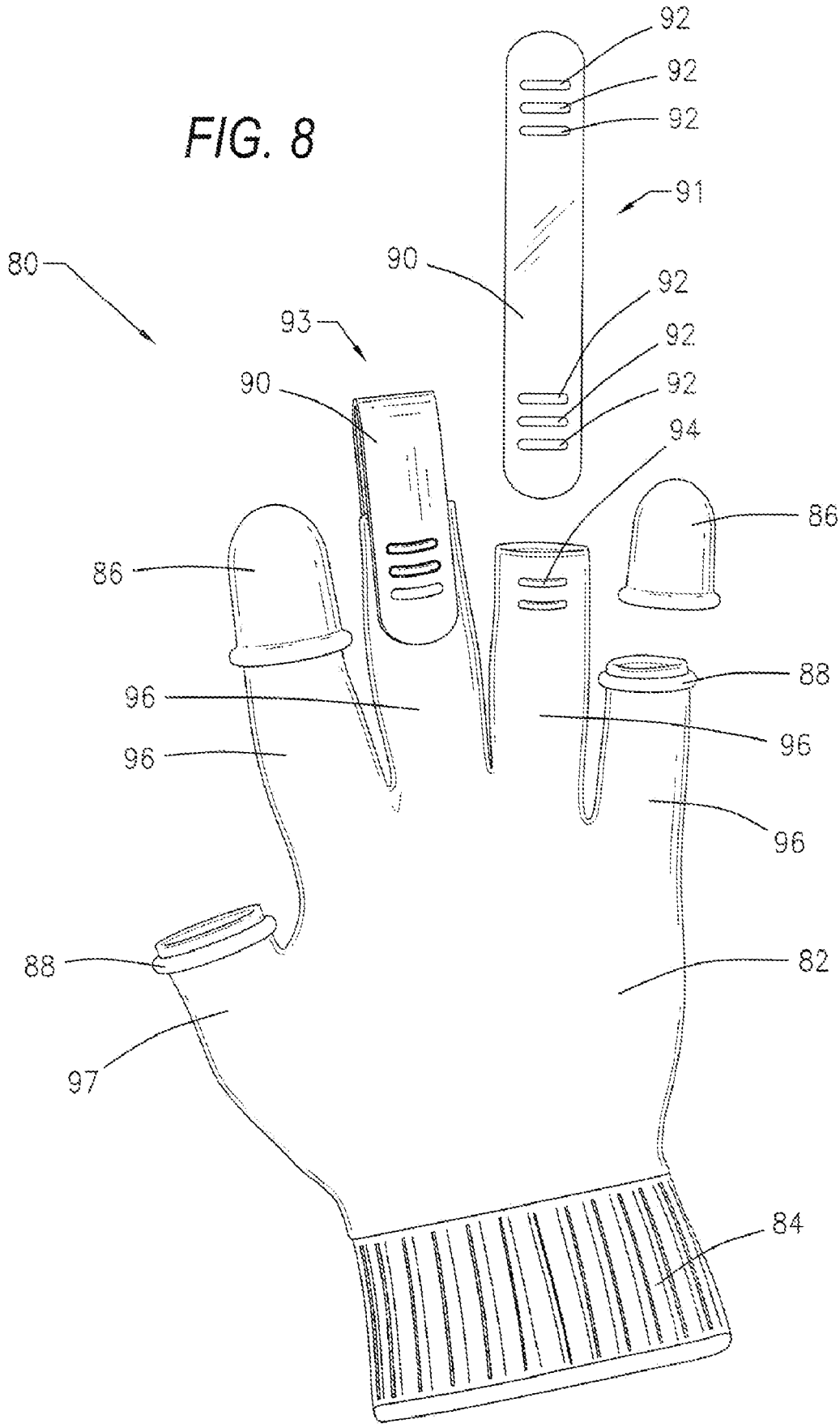
FIG. 8 shows an alternative embodiment of the invention.

FIG. 8 shows an alternative embodiment of the invention. Exercise device 80 consists of a solid body 82, as well as a cuff 84. The solid body 82 is similar to that described in the other figures. Cuff 84 assists in holding the glove in place and may consist of leather, rubber, cotton or the like. Cuff 84 is optional. Body 82 includes finger regions 96 and thumb region 97. In this particular embodiment, caps 86 may be attached to regions 96 and 97 in a fashion similar to that shown in FIG. 7. Flange 88 holds elastic caps 86 in place on the ends of finger regions 96 and thumb region 97. Embodiment 80 also shows an alternative means of increasing resistance to flexion of the distal joint. Straps 90 are made of a flexible elastic material similar to that of caps 86. Straps 90 include slots 92 that snap onto tabs 94. An unattached strap is shown at 91. When a strap 90 is attached to device 80, it appears as shown at 93. Those skilled in the art will appreciate that this provides resistance in a similar fashion as that of caps 86.

Figure 9:
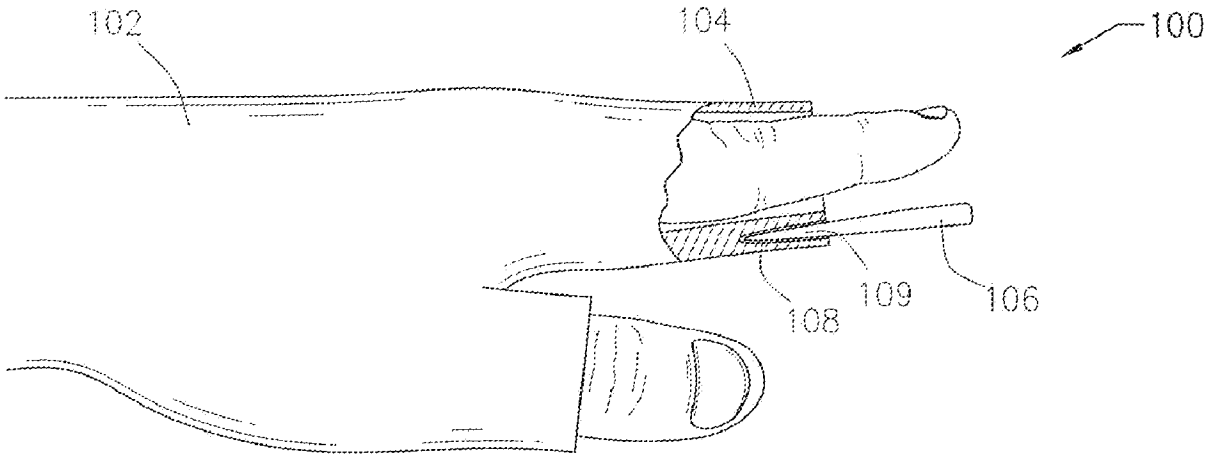
FIG. 9 shows an alternative embodiment of the invention.

FIG. 9 shows another alternative of the present invention from a side view. Alternative embodiment 100 has a solid body 102 with finger regions 104. A flat, bendable insert 106 has a tab 109 that slides into cavity 108. Insert 106 is made of elastic material as that used by caps 86 or straps 90. Those skilled in the art will appreciate that this provides similar resistance to flexion of the most DIP joint.

Figure 10:
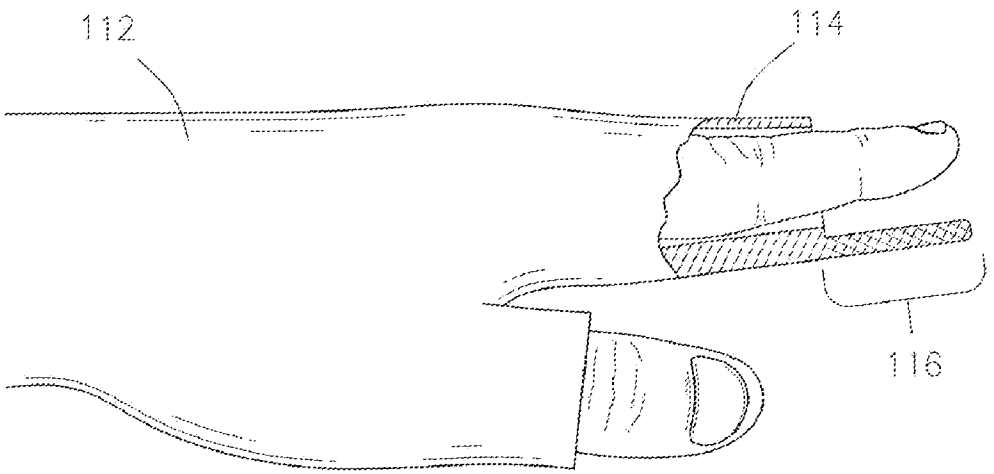
FIG. 10 shows an alternative embodiment of the invention.

FIG. 10 shows yet another alternative embodiment 110. It includes a solid body 112 having finger regions 114. In this particular embodiment, the elastic material comprises tab 116 that is permanently affixed to device 110. Tab 116 is made of similar elastic material as those used in insert 106, strips 90 and tabs 86. While the embodiment shown in FIGS. 8 and 9 allow attachment of caps, strips or inserts designed to allow adjustment of resistance, the embodiment shown in FIG. 10, having a permanently attached tab 116, provides only one level of resistance. Those skilled in the art will appreciate that this is a simpler design and may, therefore, be preferred in some circumstances.

Figure 11:
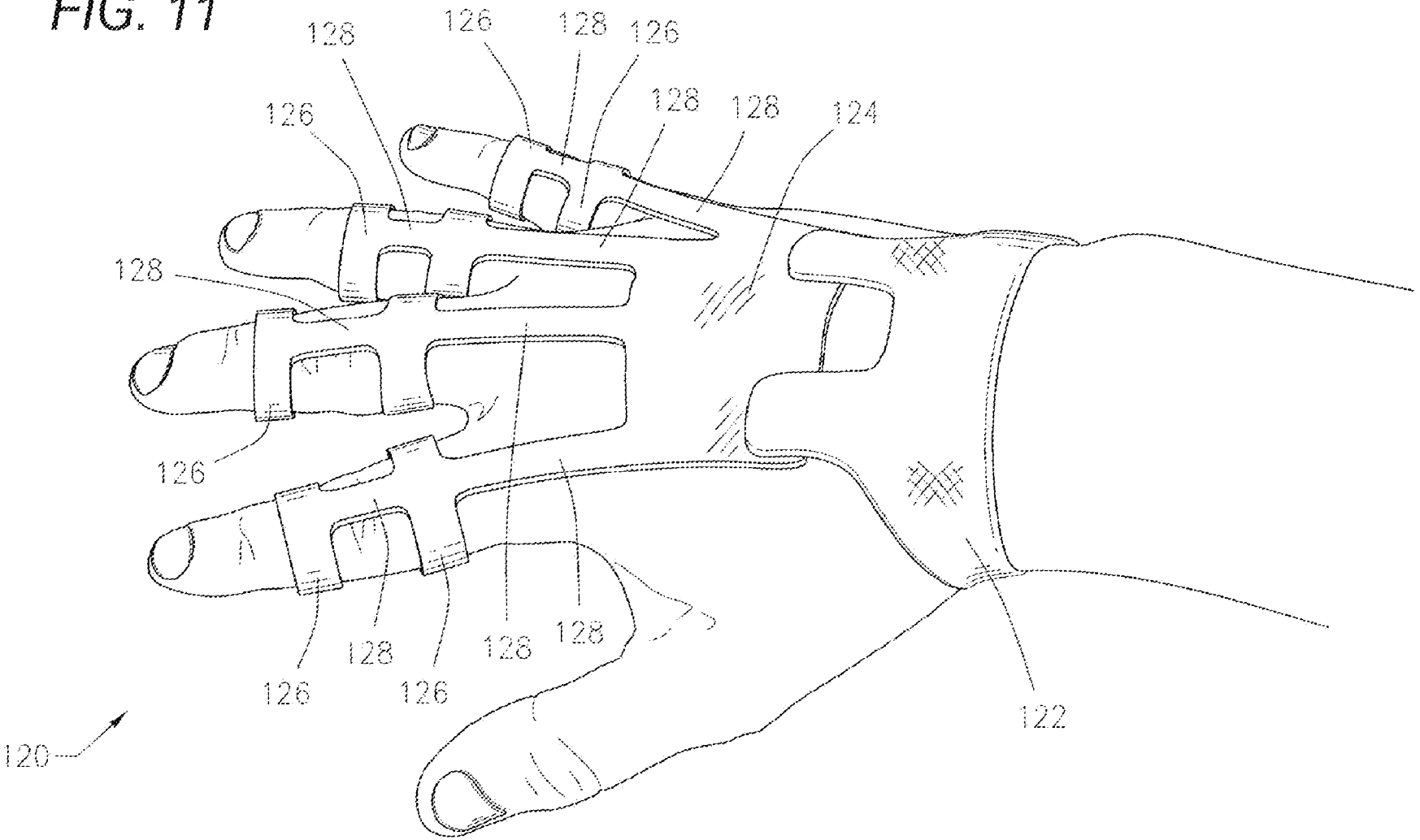
FIG. 11 shows an alternative embodiment of the invention.

FIG. 11 shows yet another alternative embodiment of the present invention. This particular embodiment 120 is designed such that it may be used by itself or may be used underneath a normal, flexible glove. It includes a rigid or elastic wrist band 122 to hold the device 120 in place. Device 120 also includes a smaller body 124 that only partially covers the top of the operator's hand. Rigid bands 126 hold device 120 firmly in place upon the operator's fingers. Rigid bands 126 are located between the joints of the fingers. They are connected by elastic bands 128. Elastic bands 128 may be comprised of the same materials used for insert 106, strips 90 and caps 86. Those skilled in the art will appreciate that the design of embodiment 120 provides resistance to the flexion of all of the phalangeal joints, but especially causes the operator to most utilize and strengthen the DIP joints.

Figure 12:
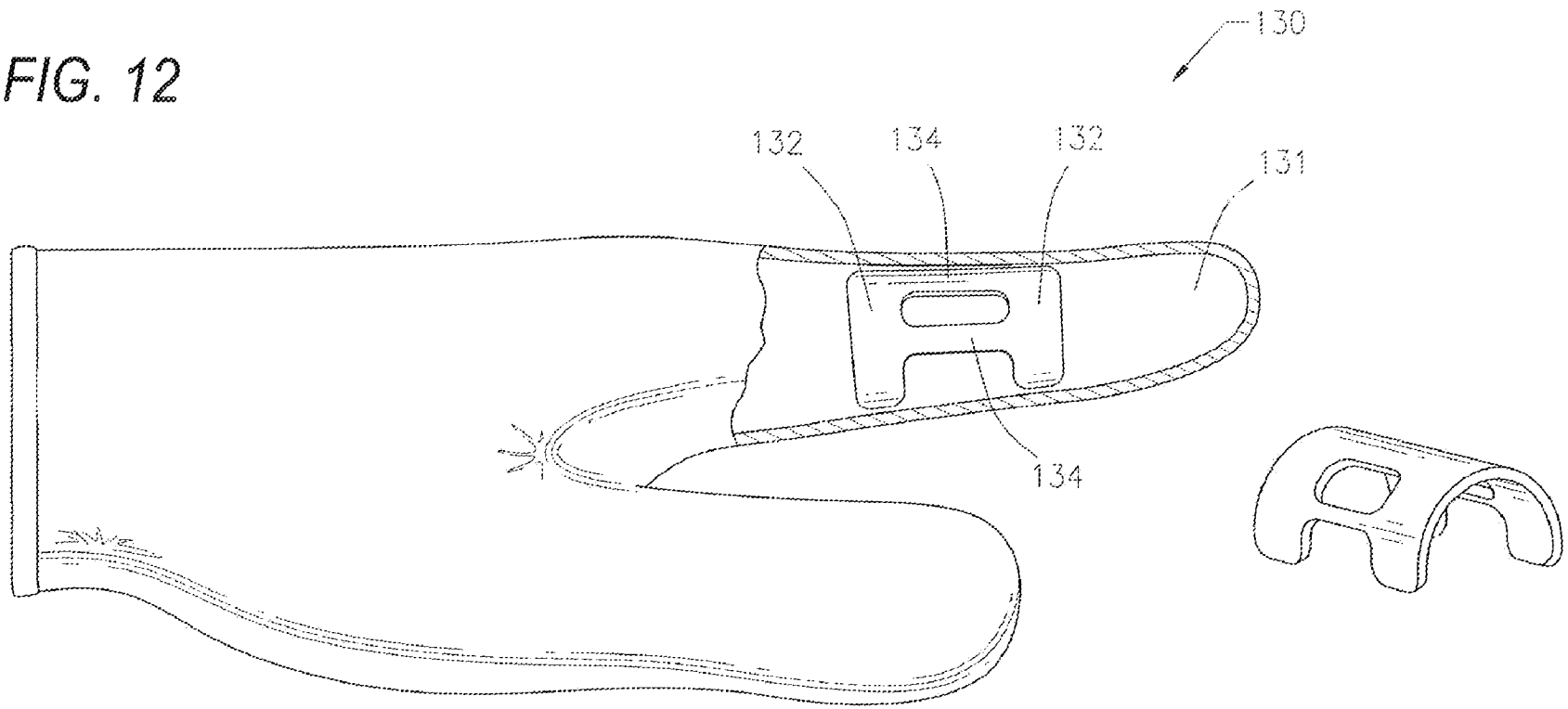
FIG. 12 shows an alternative embodiment of the invention.

FIG. 12 shows another embodiment of the present invention. This is perhaps the simplest version of the invention. It is comprised of rigid bands 132 that wrap around a finger 131. They are connected by elastic bands 134. This provides resistance to the flexion of the phalangeal joint about which it is placed. It also encourages flexion of the most distal joint. Optionally, this embodiment may be sewn, glued or otherwise attached to the inside of a flexible glove. Those skilled in the art will appreciate that the various embodiments described herein and shown in the drawings may differ in physical appearance but all have the same effect by providing resistance to flexion of the non-distal joints and encouraging flexion and strength building in the distal DIP joints.

Whereas, the present invention has been described in relation to the drawings attached hereto, it should be understood that other and further modifications, apart from those shown or suggested herein, may be made within the spirit and scope of this invention.

What is claimed is:

1. An apparatus for increasing flexibility and strength of the distal interphalangeal joints of the fingers comprising:

a rigid glove body comprising four rigid finger regions extending distally from said body past the wearer's metacarpal phalangeal and proximal interphalangeal joints but terminating short of the wearer's distal interphalangeal joint, wherein each said finger region has an opening at the distal end such that a finger inserted into each finger region is only capable of flexing the distal interphalangeal joints and such that the metacarpal phalangeal and proximal interphalangeal joints of each finger are incapable of flexion.

2. The apparatus of claim 1 further comprising a rigid thumb region having an opening distally such that it allows only flexing of the distal phalangeal joint of the thumb.

3. The apparatus of claim 1 wherein the rigid glove body includes openings that allow air to come in contact with a hand inserted into the glove.

4. The apparatus of claim 1 further comprising attachment means at the end of the finger region such that a device may be attached thereto such that the flexing of the distal interphalangeal joints encounters increased resistance.

5. The apparatus of claim 4 wherein the attachment means is selected from the group consisting of a flange, threading, tabs and cavities.

6. The apparatus of claim 4 wherein the resistance increasing device is selected from the group consisting of an elastic cap, and elastic strap having slots for attachment to tabs and an elastic tab.

7. The apparatus of claim 1 wherein the rigid glove body is comprised of at least two detachable components that allow for disassembly and reassembly of the glove body around or about the wearer's hand.

8. The apparatus of claim 1 further comprising a cuff.

9. The apparatus of claim 8 wherein the cuff is comprised of material selected from the group consisting of leather, rubber and cotton.

10. The apparatus of claim 1 further comprising a permanently attached tab at the end of the finger region that causes increased resistance the flexing of the distal interphalangeal joints.

* * * * *